United States Patent [19]

Bradlee

[11] Patent Number: 4,635,458

[45] Date of Patent: Jan. 13, 1987

[54] LEVELING APPARATUS

[75] Inventor: Charles R. Bradlee, Sidney, Ohio

[73] Assignee: Monarch Machine Tool Co., New Bremen, Ohio

[21] Appl. No.: 726,542

[22] Filed: Apr. 24, 1985

[51] Int. Cl.[4] ..... B21D 1/02

[52] U.S. Cl. ..... 72/165; 72/163

[58] Field of Search ..... 72/163–165, 72/243

[56] References Cited

U.S. PATENT DOCUMENTS

| | | | |
|---|---|---|---|
| 2,132,426 | 10/1938 | Mäusnest | 72/165 |
| 2,353,375 | 7/1944 | Todd | 72/165 |
| 2,638,143 | 5/1953 | Maust | 72/165 |
| 2,827,945 | 3/1958 | Maust | 72/163 |
| 2,949,147 | 8/1960 | Maust | 72/164 |
| 2,963,071 | 12/1960 | Krynytzky | 72/163 |
| 3,078,908 | 2/1983 | Maust | 72/163 |
| 3,078,909 | 2/1963 | Maust | 72/163 |
| 3,301,031 | 1/1967 | Bearer | 72/164 |
| 4,380,921 | 4/1983 | Matsui | 72/165 |
| 4,454,738 | 6/1984 | Buta | 72/21 |

FOREIGN PATENT DOCUMENTS

| | | | |
|---|---|---|---|
| 42606 | 12/1971 | Japan | 72/164 |

*Primary Examiner*—Daniel C. Crane

*Attorney, Agent, or Firm*—Biebel, French & Nauman

[57] ABSTRACT

A leveling apparatus having a movable frame which supports a plurality of back-up roller assemblies, each of which is individually positionable to vary the penetration of a portion of the work rolls it contacts such that the penetration of the entry work rolls can be varied independently of the penetration of the exit work roll. Each back-up roller assembly includes an elongate back-up block having a longitudinal slot and a rearwardly-positioned concave surface, an elongate support member positioned within the slot and including a rearwardly-positioned convex surface positioned to matingly engage the concave surface, and a plurality of back-up rollers positioned along the support member. The support member is urged against the back-up block by a resilient connection, and the assembly includes an adjusting screw mechanism mounted on the adjustable frame for pivoting the support member relative to the back-up block. The concave and covex portions of the back-up block and support member, respectively, have centers of curvature which coincide with the rotational axis of the rearmost associated work roll so that pivoting movement of the support member by the jack screw mechanism does not affect the penetration of the rearmost work roll.

12 Claims, 9 Drawing Figures

LEVELING APPARATUS

BACKGROUND OF THE INVENTION

The present invention relates to multi-roll leveling apparatuses for leveling metal strip material and, more particularly, to leveling apparatuses in which the penetration of the work rolls may be varied along the lengths of the work rolls.

During the process of manufacturing coils of metal strip materials such as steel, aluminum, brass and the like, variables in the process cause lack of flatness in the finished strip. The term "lack of flatness" is used to denote the deviation in the strip material from a planar configuration when uncoiled and allowed to lie flat.

For example, a rolling process in which the longitudinal edges of the strip are elongated more than the center of the strip results in a strip having wavy edges. The wavy edges accommodate the excess in length of that portion of the strip adjacent its edges. Conversely, a rolling process in which the center of the strip is elongated more than the edges results in a strip having centrally-located buckles or bubbles.

The process of working the strip to remove waves, buckles, and other deviations from a planar shape is known as "leveling", and it involves the selective elongation of the strip such that the same amount of material exists per unit length across the width of the strip. There are numerous devices for performing this elongation operation. With many of these devices the elongation is caused by passing the strip between a series of upper and lower work rolls which are offset from each other and are somewhat nested. As the strip of metal to be leveled is passed between these two sets of rolls it follows a serpentine path, flexing as it passes about the circumference of each of the work rolls.

Each of the flexes or bends about the outer surface of a work roll causes the portion of the sheet most distant from the center of curvature to be elongated, while the portion nearest the center of curvature is somewhat compressed. Successive elongations and compressions of the strip in this manner result in a strip which is substantially uniformly elongated across its width and therefore possesses the requisite flatness.

The upper and lower work rolls are positioned so that the degree of penetration or nesting decreases from the entry rolls to the exit rolls, so that the amount of flexing decreases from the front to the rear of the leveling apparatus. The final flexing of the sheet by the exit work rolls is just sufficient to return the material to a flat, planar condition.

However, sheet material frequently comprises a combination of wavy edges, center buckles and other deviations from flatness across its width so that it is necessary to vary the penetration of the work rolls along their lengths. For example, it would be necessary to increase the amount of flexing in the vicinity of the center of a sheet in order to elongate that portion and remove wavy edges on that sheet. Conversely, a center buckle appearing in a sheet would be removed by increasing the penetration of those portions of the work rolls contacting the edges of the strip, so that the edges are elongated sufficiently to correspond to the length of the center of the strip.

Another defect appearing in metal strip coils is longitudinal and transverse curvature. Longitudinal curvature occurs when one surface of the strip is longer than the opposite surface in a lengthwise direction; while transverse curvature occurs when one surface is longer than the opposite surface in a transverse direction. In contrast to the type of working required to remove wavy edges and center buckles, the removal of longitudinal and transverse curvature is accomplished by increasing the penetration of the work rolls uniformly along their lengths. Therefore, two different types of metal working are required to produce a flat strip having both longitudinal and transverse curvature as well as wavy edges and/or center buckles.

Several types of leveling apparatuses have been developed with the object of providing adjustable work rolls which remove both types of defects in a single pass. For example, the Bearer U.S. Pat. No. 3,301,031 shows a leveling apparatus in which both the upper and lower sets of work rolls are supported along their lengths by a plurality of back-up roller assemblies. Each roller assembly rests upon a pair of wedges which are adjustable to urge the roller assembly upwardly to deflect the portion of the work roll it supports, and thereby vary the penetration of the upper and lower work rolls at that location. The wedges can be positioned so that the back-up rollers urge the entry work rolls toward the strip material a greater distance than the exit work rolls are displaced, thereby varying the penetration of the work rolls along the length of the leveling apparatus.

Similarly, the Krynytzky U.S. Pat. No. 2,963,071 shows a leveling apparatus which includes a plurality of individually adjustable back-up rollers which are spaced along the lengths of the work rolls. Each back-up roller includes a support member having semicircular cavities at its front and rear portions, and the frames which support the support members include a pair of semicircular blocks which matingly engage the cavities. The blocks contact upon longitudinally-adjustable wedges so that the entry or exit portion of the support member may be adjusted to vary the elevation of the back-up rolls and therefore vary the penetration of the work rolls supported by those back-up rollers. As the wedges are displaced, the blocks pivot relative to the frames.

A disadvantage inherent in both of the aforementioned leveling devices is that it is difficult to adjust the deflection of the work rolls to correct for one type of defect in a metal strip, such as longitudinal or transverse curvature, without affecting the ability of the work rolls to correct another type of defect, such as wavy edges or center buckles. This results from the difficulty in varying the penetration of the work rolls along their lengths without varying the average penetration of the work rolls along the path traveled by the metal strip. Accordingly, there is a need for a leveling apparatus which may be adjusted to correct for wavy edges and center buckles on a strip without affecting the overall penetration of the work rolls in removing the longitudinal or transverse curvature of a strip.

SUMMARY OF THE INVENTION

The present invention is a leveling apparatus in which at least one set of work rolls is supported by a plurality of back-up roller assemblies which are individually adjustable and are capable of varying the penetration of the entry work rolls while maintaining the penetration of the rearmost work roll constant. Accordingly, the leveling apparatus of the present invention is capable of correcting wavy edge and center buckle defects simultaneously without introducing longitudinal or transverse curvature defects, since the penetration of the rearmost work rolls remains optimal for returning the strip material to a substantially flat, planar condition.

The leveling apparatus of the present invention includes a base having a fixed, lower frame which supports a plurality of fixed, back-up roller assemblies that support in nested relation a plurality of intermediate back-up rolls. The intermediate back-up rolls in turn support in nested relation a plurality of lower work rolls.

An upper frame is superposed to the lower frame and is vertically adjustable by means of four corner jack screws. The upper frame includes a mounting plate to which is attached a plurality of adjustable back-up roller assemblies. Each roller assembly includes a back-up block, a support member pivotally attached to the back-up block and a plurality of rollers rotatably attached to the support member. The rollers engage intermediate back-up rolls that in turn support upper work rolls. Each back-up block includes a rearwardly-positioned concave portion, and each support member includes a rearwardly-positioned convex portion shaped to matingly engage the concave portion. Pivotal movement of the support members is effected by the sliding engagement of the convex portions with the concave portions of the back-up blocks.

Displacement of the support members is caused by a plurality of adjusting screw mechanisms mounted on the top of the upper frame. Each mechanism includes a vertically displaceable jack screw which contacts the support member of an associated back-up roller assembly. Downward displacement of the jack screws causes the support members to rotate on their respective back-up blocks so that the convex portions of the support members slide against the concave portions of the back-up blocks.

In the preferred embodiment, the concave portions of the back-up blocks and convex portions of the support members each have centers of curvature which coincide with the rotational axis of the rearmost top work roll. Consequently, pivotal movement of the support members in response to vertical displacement of the jack screws does not affect the position of the rearmost top work roll, so that the penetration of that roll with respect to the two rearmost lower work rolls remains constant for a specific upper frame elevation. As a result, each individual back-up roller assembly mounted on the upper frame may be individually adjusted to increase or decrease penetration of the portion of the upper work rolls directly beneath it, but such variances decrease with each succeeding work roll from front to rear, such that the penetration of the rearmost top work roll is unaffected.

The leveling device of the present invention is therefore capable of removing both the wavy edges or center buckle defects and the transverse or longitudinal curvature defects from a strip since both the average penetration of the work rolls may be adjusted as well as, and independently of, the penetration of specific segments along the lengths of the work rolls. Therefore, the leveling apparatus of the present invention is capable of removing the two most common defects in strip material in a single pass.

While the foregoing discussion has been directed to an embodiment of the invention in which the individually adjustable back-up roller assemblies are attached to an upper, adjustable frame, other arrangements of back-up roller assemblies are within the scope of the invention. For example, individually adjustable back-up roller assemblies may be mounted on a lower adjustable frame, or on lower and upper adjustable frames. However, it is believed that the most economical and efficient configuration is to provide only a single set of back-up roller assemblies attached to one of the two frames of the leveling apparatus.

The back-up roller assemblies of the invention may be utilized in a leveling apparatus which lacks the intermediate back-up rolls which will be described for the preferred embodiment. However, this is less desirable since direct contact between the rollers of the back-up roller assemblies and the work rolls increases the tendency of the leveled strip to receive longitudinal markings which result from the localized pressure applied to the work rolls across the width of the strip. In a preferred embodiment, the work rolls opposing the work rolls supported by the adjustable back-up roller assemblies are supported by fixed back-up roller assemblies positioned in direct, opposing relation to the adjustable back-up roller assemblies.

Accordingly, it is an object of the present invention to provide a leveling apparatus which simultaneously removes defects from metal strip resulting in wavy edges and center buckles as well as defects resulting in transverse and longitudinal curvature; a leveling apparatus in which the penetration of the rearmost work rolls remains constant while the penetration of the entry work rolls may be varied from the front to the rear of the leveling apparatus and along the lengths of the individual work rolls; and a leveling apparatus in which adjustments in the penetration of the work rolls may be made relatively easily and by a relatively uncomplicated apparatus.

Other objects and advantages of the invention will be apparent from the following description, the accompanying drawings and the appended claims.

DETAILED DESCRIPTION OF THE PREFERRED EMBODIMENT

Figure 1:
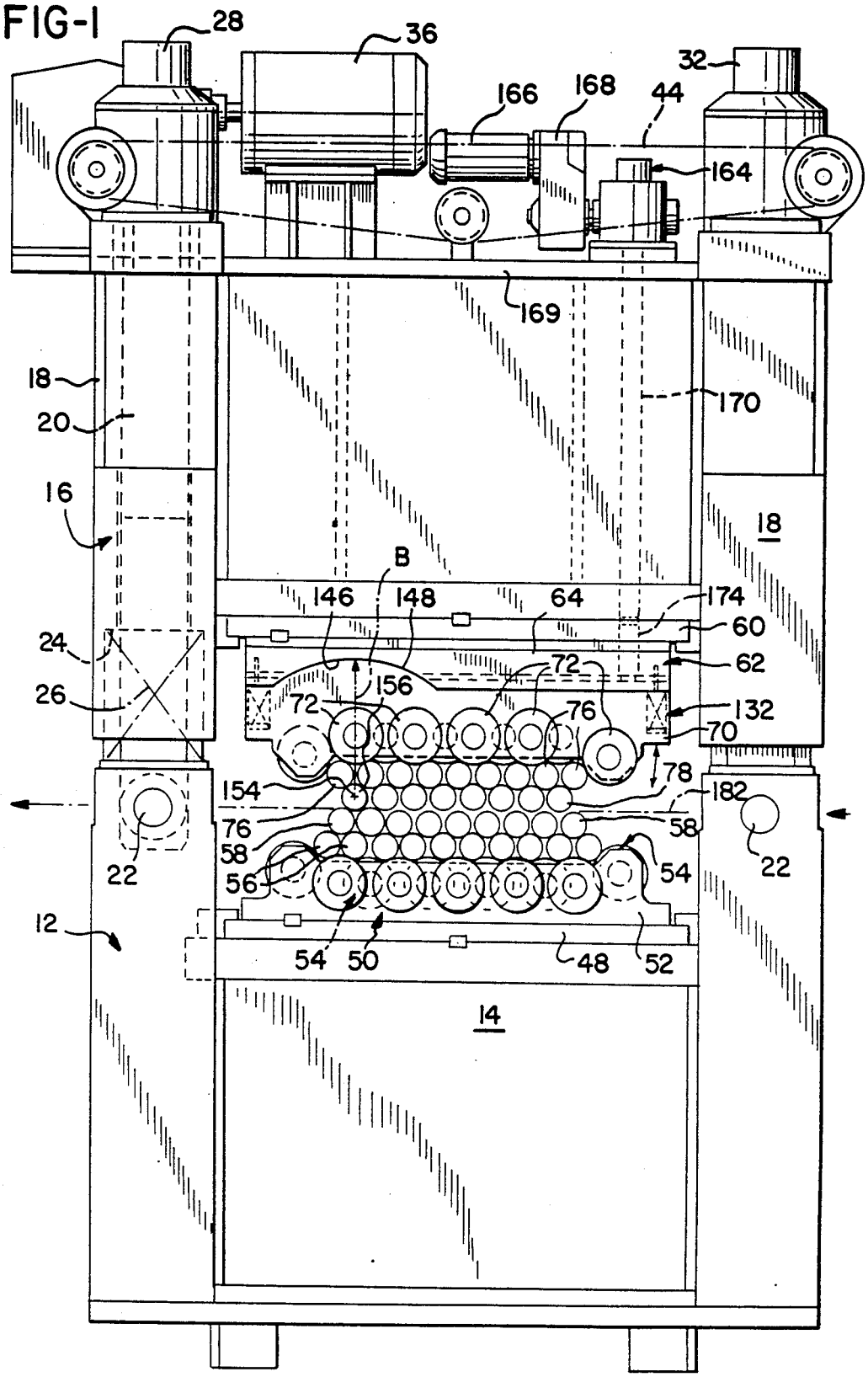
FIG. 1 is a somewhat schematic side elevational view of a leveling apparatus incorporating a preferred embodiment of the invention.
Figure 2:
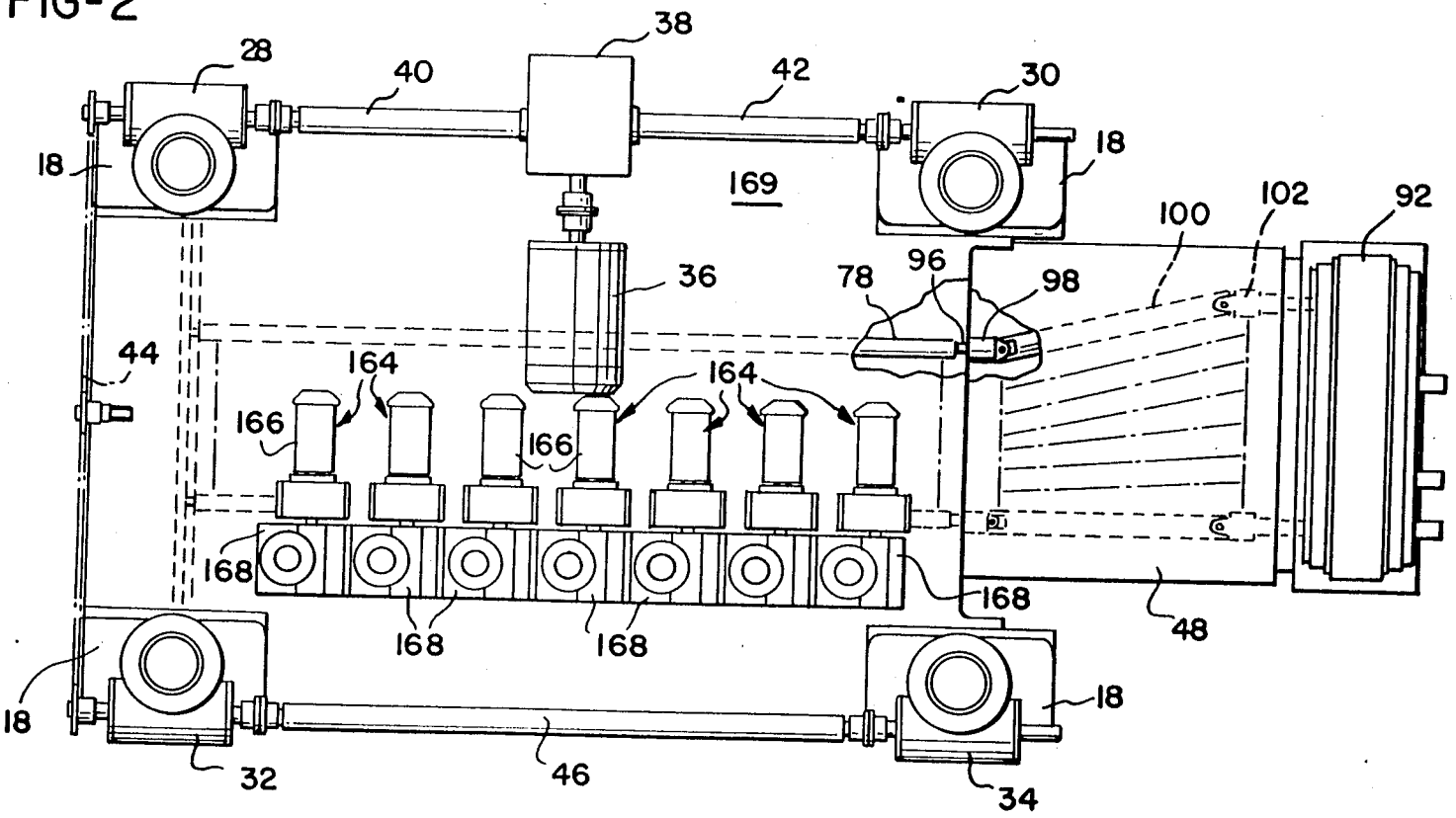
FIG. 2 is a somewhat schematic top plan view of the leveling apparatus of FIG. 1 in which the upper work rolls and drive couplings are shown in phantom and in which the apparatus is partially broken away to show a connection between an upper work roll and a drive shaft.

As shown in FIGS. 1 and 2, the leveling apparatus of the present invention includes a fixed base 12 which supports a fixed lower frame 14 and a vertically adjustable upper frame 16. The upper frame 16 includes four corner columns 18 through which extend four jack screws 20 (only one of which is shown in FIG. 1) which are connected to the base by pivot connections 22 at their lower ends. The four jack screws 20 each engage gear boxes 28, 30, 32 and 34, located on the tops of the four corner columns 18.

An electric motor 36 is drivingly coupled to a splitter gear box 38 which drives shafts 40, 42 that directly rotate gear boxes 28, 30, respectively. A chain drive 44 connects gear box 28 to gear box 32, and a drive shaft 46 connects gear box 32 to gear box 34. Thus, the single motor 36 simultaneously drives gear boxes 28–34 so that the upper frame 16 moves upwardly or downwardly along jack screws 20 in a uniform manner.

Figure 3:
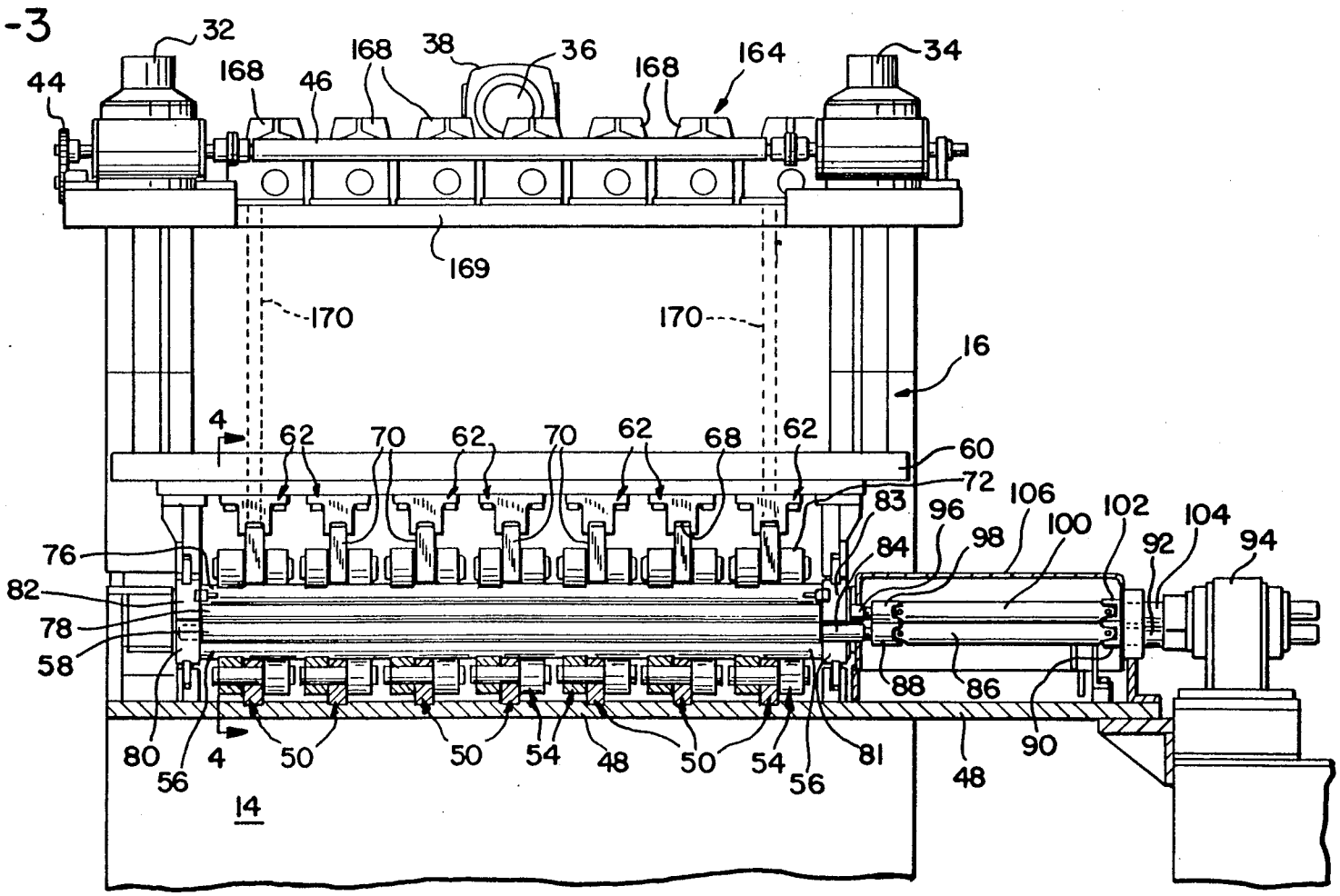
FIG. 3 is a somewhat schematic, partial front elevational view of the leveling apparatus of FIG. 1 in which the lower back-up roller assemblies and drive coupling housing are shown in section.

As shown in FIGS. 1 and 3, the lower frame 14 includes a mounting plate 48 on which is attached a plurality of fixed, lower back-up roller assemblies 50. Each lower back-up roller assembly includes a lower support member 52 mounted on plate 48 and on which is rotatably mounted a plurality of lower back-up rollers, generally designated 54. A plurality of lower intermediate back-up rolls 56 are supported by and nested between the lower back-up rollers 54. These rolls in turn support a plurality of lower work rolls 58 in nested relation.

As shown in FIGS. 1, 3, 4 and 9, the upper frame 16 includes a mounting plate 60 to which is attached a plurality of upper back-up roller assemblies 62. Each back-up roller assembly 62 includes a back-up block 64 which is attached to the underside of the mounting plate 60 by bolts 66. The back-up blocks 64 are elongate in shape and extend longitudinally of the leveling apparatus. The back-up blocks 64 each define a longitudinal channel 68 which receives a support member 70. The support members 70 are substantially coextensive of the elongate slots 68.

Figure 4:
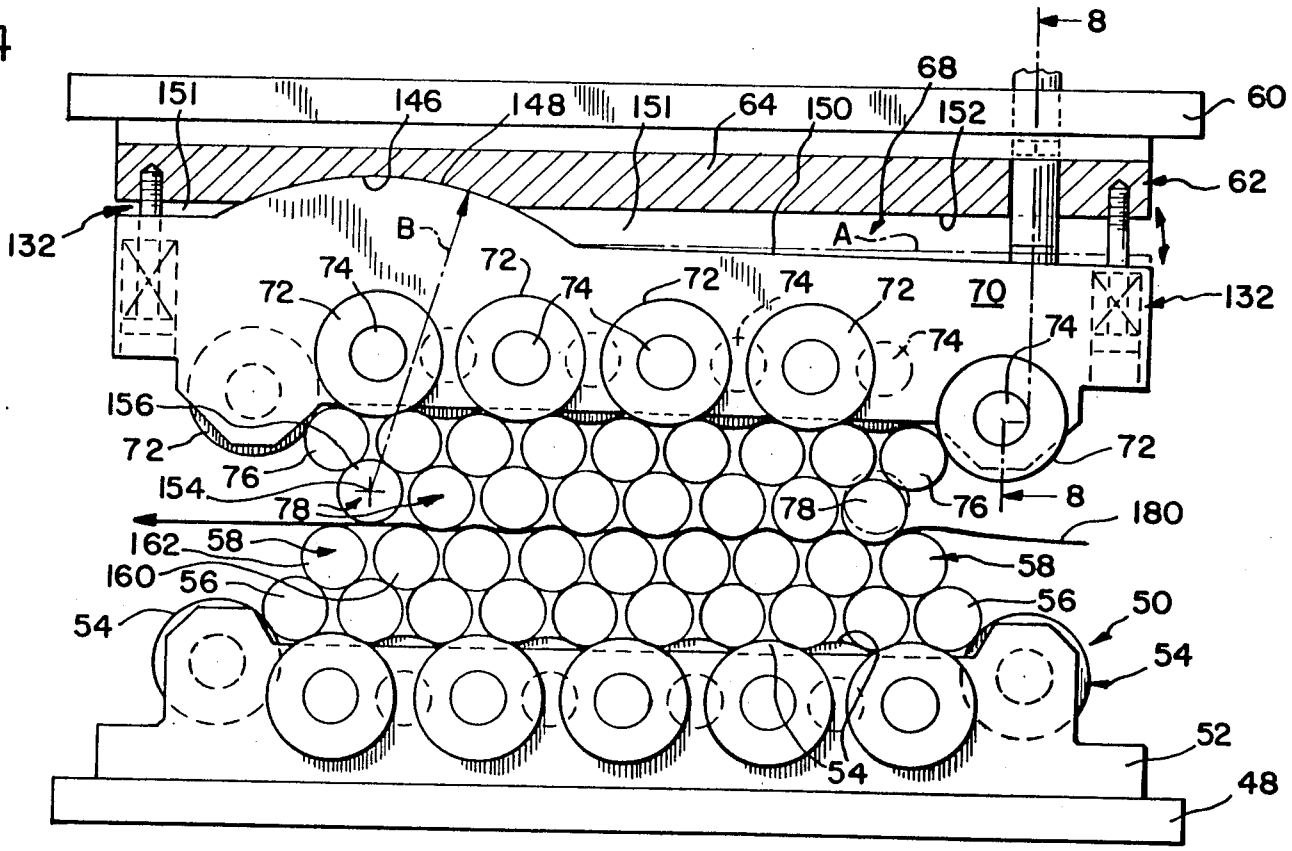
FIG. 4 is a somewhat schematic detail side elevational view of the upper and lower work roll assemblies, taken at line 4—4 of FIG. 3.

A plurality of back-up rollers 72 are rotatably mounted on stubs 74 which are pressed into the support member 70 so that the rollers are positioned on alternate sides of the support member. As best shown in FIGS. 1 and 4, the upper back-up rollers 72 are nested against a plurality of upper intermediate back-up rolls 76. The intermediate back-up rolls 76 in turn are nested against a plurality of upper work rolls 78.

As shown in FIG. 3, the lower work rolls 58 are journaled into lower opposing side plates 80, 81 which are fixed flexibly to the lower plate 48. Each lower work roll 58 includes a stub extension 84 which is connected to a drive shaft 86 by a universal joint 88. The drive shafts 86 are connected by universal joints 90 to the output shafts 92 of a transmission 94. The transmission 94 is driven by an electric motor (not shown). The lower intermediate back-up rolls 56 are rotatably retained between lower side plates 80, 81 by well-known means (not shown).

Similarly, each upper work roll 78 includes a stub extension 96 extending from one end which is connected by a universal joint 98 to an upper drive shaft 100. Each upper drive shaft 100 is connected by a universal joint 102 to upper output shafts 104 of the transmission 94 (also shown in FIG. 2). The upper and lower drive shafts 100, 86, respectively, and their associated universal joints are enclosed in a housing 106 which is mounted on an extension of the mounting plate 48.

The upper work rolls 76 are journaled into opposing upper side plates 82, 83 which are flexibly attached to mounting plate 60 to allow for vertical adjustment relative to the lower work rolls 58.

Figure 6:
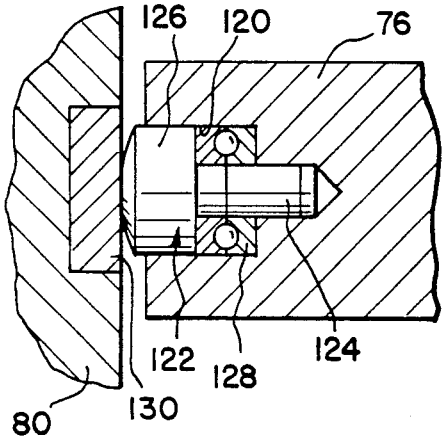
FIG. 6 is a detail front elevational view in section of the leveling apparatus of FIG. 1 showing a typical rotatable connection between an intermediate back-up roll and a frame.

As shown in FIG. 6, the ends of the upper intermediate back-up rolls 76 each include a recess 120 which receives a roller 122 having an axle 124 pressed into the end of the roll and a head 126. Each head 126 is positioned adjacent to a thrust bearing 128 seated within the recess 120 and rotates against a wear plate 130 set into the upper side plates 82, 83.

The upper intermediate back-up rolls 76 also include such a roller bearing assembly to engage a wear plate (not shown) in upper side plates 82 and 83, identical to that shown in FIG. 6. Thus, the intermediate back-up rolls 76 are capable of vertical movement in which the rollers 122 at both ends of each roll 76 slide and rotate against the wear plates 130, but are constrained with regard to movement along their longitudinal axes, or laterally of the leveling apparatus.

Figure 7:
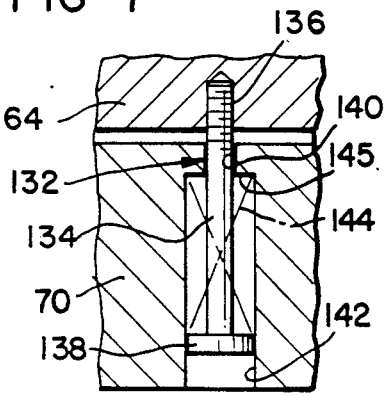
FIG. 7 is a detail side elevation in section of the leveling apparatus of FIG. 1 showing a typical resilient connection between a support member and an associated back-up block.
Figure 8:
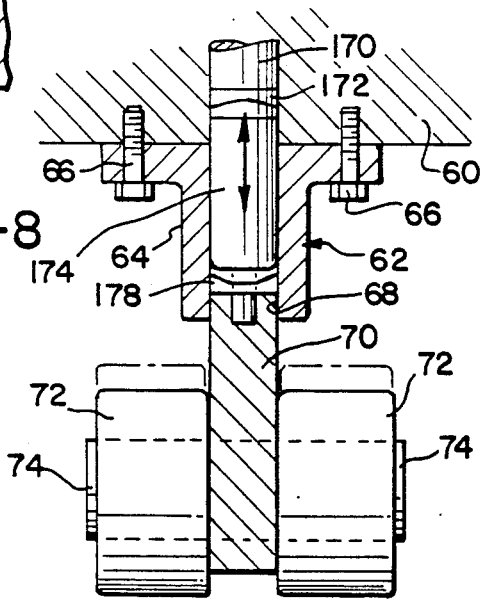
FIG. 8 is a detail front elevation in section showing a typical back-up roller assembly, taken at line 8—8 of FIG. 4.

As shown in FIGS. 3, 4 and 7, each support member 70 is attached to its respective back-up block 64 by a pair of resilient connections 132, located adjacent to forward and rearward ends of the member. Each resilient connection 132 includes a shaft 134 threaded into the back-up block 64 at an upper end 136 and a lower disk-shaped head 138. The shaft 134 extends through a hole 140 which opens into a recess 142 in the support member 70. A compression spring 144 is seated on the head 138 and is positioned to abut the end 145 of the recess.

As shown in FIG. 4, the rearward portion of the back-up block 64 includes a downwardly-opening concave surface 146 and the rearward portion of the support member 70 includes an upwardly-extending convex portion 148, which is positioned to matingly engage and slide against the concave portion 146. The convex portion 148 extends from the upper surface 150 of the support member sufficiently to provide a clearance space 151 between the support member 70 and the bottom 152 of the slot 68 to allow for pivotal movement of the support member relative to the back-up block 64, as indicated by broken line A in FIG. 4.

The concave portion 146 and convex portion 148 both have centers of curvature which coincide with the rotational axis 154 of the rearmost top work roll 156. Accordingly, both the concave portion 146 and convex portion 148 have a radius represented by line B, so that pivotal movement of the support member 70, which causes the convex portion 148 to slide against the concave portion 146, results in the support member 70 pivoting about the rotational axis 154 of the rearmost work roll 156. While the pivoting movement of the support member 70 causes a greater or lesser pressure to be exerted upon the intermediate back-up rolls 76 and ultimately upon the upper work rolls 78, which increases or decreases the penetration of the upper work rolls relative to the lower work rolls 58, the penetration of the rearmost upper work roll 156 remains unchanged relative to the two rearmost lower work rolls 160, 162.

Each upper back-up roller assembly 62 includes an adjusting screw mechanism 164, shown in FIGS. 1, 2 and 3. Each adjusting screw mechanism 164 includes a separate drive motor 166 which is drivingly connected to a gear box 168, both of which are mounted on the top plate 169. Each gear box 168 receives the upper end of a jack screw 170 which extends downwardly through the upper frame 16 and mounting plate 60.

Figure 5:
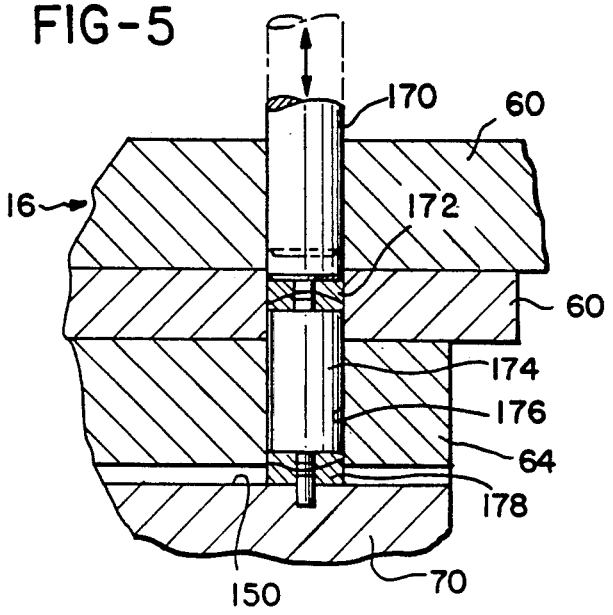
FIG. 5 is a detail side elevation in section of the leveling apparatus of FIG. 1 showing a connecting pin extending between a jack screw and a support member of a typical back-up roller assembly.

As best shown in FIG. 5, the lower end of each jack screw 170 engages the upper one of a pair of spherical bearings 172, the lower one of which engages a removable pin 174 fitted within a bore 176 formed in the back-up block 64. The lower end of each pin is connected to a second set of spherical bearings 178 which abut the upper surface 150 of the support member 70.

The spherical bearings 172, 178 provide a positive connection between the jack screw 170 and pin 174, and between the pin 174 and support member 70, throughout the range of pivotal movement of the support member, and to compensate for any misalignment between components. The pins 174 facilitate the removal or replacement of the entire assembly attached to mounting plate 60 from the frame 16.

As best shown in FIG. 1 the motor 166 of each adjusting screw mechanism 164 may be independently actuated to raise or lower its associated jack screw 170, to position its back-up roller assembly 62. A downward displacement of a jack screw 170 causes its associated support member 70 to pivot in a clockwise direction about axis 154, so that the penetration of the upper work rolls 78 (with the exception of the rearmost work roll 156) is increased. An upward displacement of a jack screw 170 allows the resilient members 132 to pivot the support member 70 in a counterclockwise direction relative to back-up block 64 so that the penetration of the work rolls 78 is decreased.

Since the support members travel in a circular path about axis 154, the change in roll penetration for a given degree of pivotal movement of a support member 70 is greatest for the entry work roll, and the degree of change decreases for each succeeding work roll. As mentioned previously, the penetration of the rearmost work roll 158 remains unchanged. Consequently, the amount of elongation imparted to a section of strip, caused by a downwardly pivoted support member 70, successively decreases with each work roll from the front to the rear of the leveler, so that the penetration of the rearmost work rolls 156 remains sufficient to return the strip to a planar configuration, regardless of the orientation of any of the support members 70.

Figure 9:
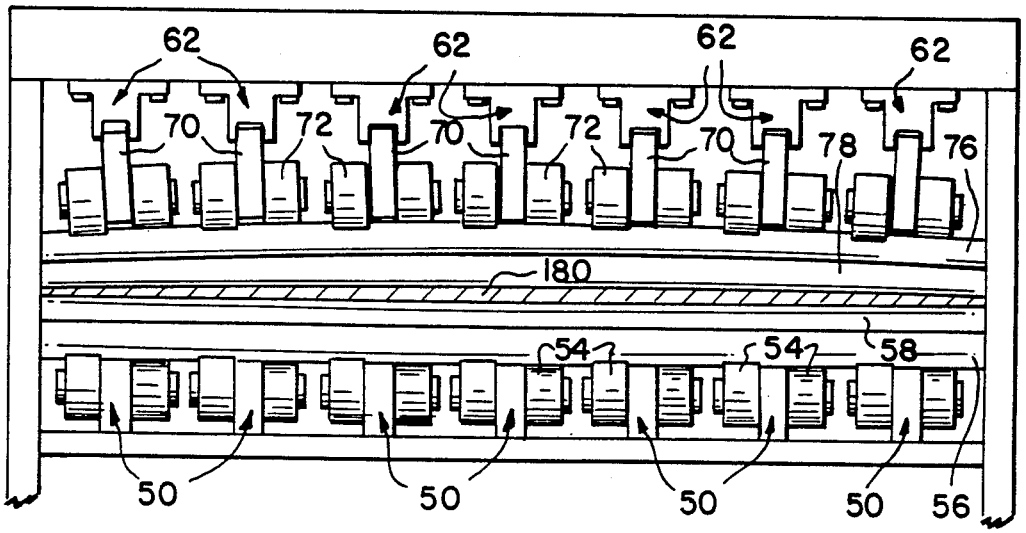
FIG. 9 is a somewhat schematic detail front elevational view showing the deflection of work rolls by a segment of metal strip in the leveling apparatus of FIG. 1.

As shown in FIG. 9, there are a number of individual back-up roller assemblies 62 positioned along the lengths of the intermediate back-up rolls 76, and upward or downward displacement of the support member 70 of a single one of the back-up roller assemblies will result in a deflection of the intermediate back-up roll 76 and upper work roll 78 only in the region immediately below that particular roller assembly. Therefore, defects in a strip 180 passing between the upper and lower work rolls 78, 58, respectively, can be removed by an appropriate coordinated displacement of individual support members 70 immediately above that defect.

For the strip 180 shown in FIG. 9, the defect is that the length of the center of the strip is greater than at the edges, resulting in center buckle. In order to remove such a defect the support members 70 of the roller assemblies 62 immediately above the edges of the strip are deflected downwardly by their associated adjusting screw mechanisms 164 (FIG. 2), thereby increasing the penetration of the work rolls 78 in the region of the edge of the strip. However, as mentioned previously, the pivoting movement of those individual support members 70 does not affect the penetration of the rearmost top work roll 154, so that the amount of additional elongation of the strip 180 decreases with each pass about the upper and lower work rolls 78, 58, and the penetration of the rearmost work roll 154 is sufficient to place the strip 180 in a substantially planar configuration as it exists the leveling apparatus.

Accordingly, the operation of the leveling apparatus is as follows. A strip of metal is fed into the leveling apparatus from right to left, as shown in FIGS. 1 and 4, and extends between the upper and lower sets of work rolls 78, 58. Depending upon the thickness and properties of the strip as it enters the leveling apparatus, the upper frame 16 will be raised or lowered by the corner jack screws 20 to adjust the final penetration of the upper work rolls 78 into the lower work rolls 58. This is best seen in FIG. 1 in which a dividing line 182 extends between the upper and lower work rolls. Penetration is increased when the upper work rolls 78 are urged downwardly.

Once the final penetration of the upper work rolls 78 has been set, the individual adjusting screw mechanisms 164 are continuously actuated to pivot their respective support members 70 to vary the penetration of those portions of the upper work rolls 78 immediately below them, in order to correct for waves or buckles in the sheet 180 in those areas immediately below the specific upper back-up roller assemblies 62.

Although not shown, each adjusting screw 164 may be actuated by an operator, or by utilizing well-known sensor mechanisms, such as those disclosed in Buta U.S. Pat. No. 4,454,738, the disclosure of which is incorporated herein by reference.

Since the rollers 72 of the upper back-up roller assemblies 62, and the rollers 54 of the lower back-up roller assemblies 50 are not continuous rolls like intermediate back-up rolls 76, 56, there is a tendency for the strip 180 to receive longitudinal markings corresponding to the outer edges of the rollers. However, two components of the leveling apparatus act to reduce the formation of such markings.

First, the preferred embodiment of the invention includes intermediate back-up rolls 76, 56 which are interposed between the rollers 72, 54 and the work rolls 78, 58, respectively. And second, the back-up rolls may be provided with spiral grooves which break up the pattern created by back-up rollers 54 and 72. It has been found that such an arrangement is effective in reducing the formation of longitudinal markings on the strip.

While the form of apparatus herein described constitutes a preferred embodiment of this invention, it is to be understood that the invention is not limited to this precise form of apparatus, and that changes may be made therein without departing from the scope of the invention.

What is claimed is:

1. A leveling apparatus of the type having first and second sets of work rolls positioned in opposing, nested relation and forming an undulating path therebetween for metal strip material, said path extending longitudinally of said apparatus from entry rolls of said first and second sets at a forward end of said apparatus to rearmost rolls of said first and second sets at a rearward end of said apparatus, means for supporting said first set of work rolls, means for supporting said second set of work rolls, and means for displacing said second set of work rolls toward and away from said first set, wherein the improvement comprises said second support means including:

a back-up block having a rearwardly positioned concave portion extending longitudinally thereof and being superposed to said rearmost work roll of said second set, said back-up block having a center of curvature coinciding with a rotational axis of said rearmost work roll of said second set;

a longitudinally-extending support member having a rearwardly positioned convex portion matingly engaging said concave portion and being superposed to said rearmost work roll of said second set, said support member having a center of curvature coinciding with said rotational axis;

a plurality of back-up rollers supporting said second set of work rolls and extending along said support member; and means for pivoting said support member relative to said back-up block and about said rotational axis such that said convex portion slides against said concave portion, whereby penetration of said rearmost work roll of said second set relative to said first set of work rolls is unchanged, and penetration of all remaining ones of said second set of work rolls relative to said first set of work rolls is varied increasingly from said rearward end to said forward end.

2. The leveling apparatus of claim 1 wherein said convex portion extends outwardly from said support member sufficiently to space said support member from said back-up block and form a gap therebetween to allow for relative pivotal movement of said support member to said back-up block.

3. The leveling apparatus of claim 1 further comprising a plurality of said back-up blocks, said support members, said back-up rollers and said pivoting means, together forming a plurality of back-up roll assemblies spaced transversely of said apparatus and being independently adjustable whereby work rolls of said second set of work rolls may be deflected at predetermined locations therealong toward said first set of work rolls.

4. The leveling apparatus of claim 3 further comprising a plurality of intermediate back-up rolls positioned in nested relation to said second work roll means, said back-up rollers being positioned to contact said intermediate back-up rolls.

5. The leveling apparatus of claim 4 wherein said first support means includes a plurality of first back-up roll assemblies positioned in opposing relation to said back-up roll assemblies of said second support means, each including a plurality of back-up rollers.

6. The leveling apparatus of claim 5 wherein said first support means includes a plurality of first intermediate back-up rolls positioned in nested relation to said first work roll means, said first back-up roll assemblies being positioned such that said support rollers thereof contact and support said first intermediate back-up rolls.

7. A leveling apparatus having a base, first and second frame means attached to said base and reciprocable relative to each other, first work roll means, first means for supporting said first work roll means and attached to said first frame means, second work roll means, second means for supporting said second work roll means and attached to said second frame means, said first and second work roll means being in nested relation to each other and forming an undulating path for metal strip material extending longitudinally of said apparatus from a front to a rear thereof, wherein the improvement comprises said second support means including;

a back-up block attached to said second frame means and including a longitudinally-extending concave portion;

a support member having a longitudinally-extending convex portion extending outwardly therefrom and positioned to matingly engage said concave portion;

a plurality of back-up rollers rotatably attached to said support member and positioned to support said second work roll means;

means for pivoting said support member relative to said back-up block such that said convex portion slides against said concave portion, whereby said back-up rollers are urged toward or away from said second work roll means so that work rolls thereof may be selectively deflected; and said pivoting means including resilient means connecting said support member to said back-up block at front and rear ends thereof, and adjusting screw means mounted on said second frame means and operatively connected to said support member.

8. The leveling apparatus of claim 7 wherein said back-up block is elongate in shape and includes a central, longitudinally-extending slot, said back-up block extending longitudinally of said second frame means.

9. The leveling apparatus of claim 8 wherein said support member is plate-shaped and sized to fit within said slot.

10. The leveling apparatus of claim 9 wherein said back-up rollers extend along said support member and are positioned alternately on opposite sides thereof.

11. The leveling apparatus of claim 7 wherein said adjusting screw means includes a motor mounted on said second frame means, gear means driven by said motor and jack screw means driven by said gear means and extending through said back-up block to engage said support member at a forward end thereof.

12. A leveling apparatus of the type having a base for supporting said apparatus, lower frame means fixed to said base, a plurality of lower driven work rolls rotatably attached to said lower frame means, a plurality of lower intermediate back-up rolls positioned in nested relation to and supporting said lower work rolls, upper frame means superposed to said lower frame means and attached to said base for reciprocable movement relative to said lower frame means, a plurality of upper, driven work rolls superposed to and in nested relation to said lower work rolls, a plurality of upper intermediate back-up rolls positioned in nested relation and supporting upper work rolls, said upper and lower work rolls being in nested relation to each other and forming an undulating path for metal strip material extending longitudinally of said apparatus from a front to a rear thereof, the improvement comprising:

a plurality of lower back-up roller assemblies mounted on and spaced transversely of said lower frame means, each of said lower back-up roller assemblies including an elongate lower support member attached to and extending longitudinally of said lower frame means beneath said lower intermediate back-up rolls, and a plurality of lower back-up rollers rotatably attached to said lower support member and positioned to contact and nest between said lower intermediate back-up rolls; and a plurality of upper back-up roller assemblies mounted on and spaced transversely of said upper frame means, each of said upper roller assemblies having an elongate upper back-up block mounted on and extending longitudinally of said upper frame means, said upper back-up block having a longitudinal slot and a lower concave surface superposed to a rearmost one of said upper work rolls and having a center of curvature coinciding with a rotational axis of said rearmost upper work roll, an elongate upper support member positioned within said slot and including an upper convex surface positioned to matingly engage said concave surface and having a center of curvature coinciding with said rotational axis of said rearmost upper work roll, said convex surface extending outwardly from said upper support member sufficiently to space an upper surface of said upper support member from a lower surface of said upper back-up block and form a gap therebetween to allow for relative pivotal movement of said upper support member to said upper back of block, a plurality of upper back-up rollers rotatably attached to and extending along said upper support member in alternating relation, said upper back-up rollers being positioned in opposite relation to said lower back-up rollers and in contacting, nested relation to said upper intermediate back-up rolls, resilient means for urging said upper support member against said upper back-up block, and adjusting screw means mounted on said upper frame means and including jack screw means extending through said upper back-up block to contact said upper support member such that displacement of said jack screw causes said convex surface to slide against said concave surface, whereby said upper support member pivots relative to said upper back-up block to urge said upper back-up rollers against said upper intermediate back-up rolls to deflect said upper work rolls so that penetration of forward ones of said upper work rolls is adjusted without affecting penetration of said rearmost work roll.

* * * * *